United States Patent [19]

Snyder

[11] Patent Number: 4,828,188

[45] Date of Patent: May 9, 1989

[54] PAPER SHREDDING DEVICE

[76] Inventor: Peter Lloyd-Simon Snyder, 2325 Brookside Way, Indialantic, Fla. 32903

[21] Appl. No.: 216,516

[22] Filed: Jul. 8, 1988

[51] Int. Cl.[4] ..... B02C 18/22

[52] U.S. Cl. ..... 241/36; 241/81; 241/100; 241/235; 241/DIG. 30

[58] Field of Search ..... 271/99, 196, 197; 209/553, 643, 474, 932; 241/62, 81, 36, 235, 100, 236, DIG. 30

[56] References Cited

U.S. PATENT DOCUMENTS

| | | | |
|---|---|---|---|
| 3,724,766 | 4/1973 | Bosland | 241/100 |
| 3,880,361 | 4/1975 | Schwarz . | |
| 4,166,030 | 8/1979 | Lewis et al. | 241/81 X |
| 4,236,676 | 12/1980 | Bialski et al. . | |
| 4,257,565 | 3/1981 | Hatanaka | 241/100 |
| 4,403,743 | 9/1983 | Ducasse . | |
| 4,489,896 | 12/1984 | Cerroni . | |
| 4,678,126 | 7/1987 | Prentice et al. . | |
| 4,754,933 | 7/1988 | Leuthold et al. | 241/100 |

FOREIGN PATENT DOCUMENTS

| | | | |
|---|---|---|---|
| 2528268 | 12/1976 | Fed. Rep. of Germany | 241/100 |
| 2817740 | 10/1979 | Fed. Rep. of Germany | 241/100 |

*Primary Examiner*—Mark Rosenbaum
*Attorney, Agent, or Firm*—Jerry T. Kearns

[57] ABSTRACT

A paper shredding device for separating and shredding a carbon paper sheet from a credit card invoice slip having a first original copy separated by a carbon paper sheet from a second copy has a rectangular housing which encloses a rotationally driven cutter roller and a pair of adjacent idling anvil rollers. An insertion slot is formed in an end wall of the housing and communicates with an internal channel. A pair of vertically spaced perforated vacuum plates form ceiling and floor portions of the channel adjacent the insertion slot. Upper and lower receptacles are provided and each communicate via a slot with the internal channel. In use, the original copy and the second copy are directed respectively to the upper and lower receptacles and the carbon paper sheet is directed through the internal channel to the cutter roller for shredding. A microswitch is provided for actuating the vacuum plates and cutter roller upon insertion of a credit card invoice into the insertion slot. The cutter roller is driven by a worm gear drive shaft operatively connected to a drive motor. p

6 Claims, 3 Drawing Sheets

10
12
14
16
18
20
22
24
26

12
18
20
22
24
26
28
30
32
34
36
50

PAPER SHREDDING DEVICE

BACKGROUND OF THE INVENTION

1. Field of the Invention

The present invention relates to paper shredding devices, and more particularly pertains to a new and improved paper shredding device for separating and shredding a carbon paper sheet from a credit card invoice slip having a first original copy separated by a carbon paper sheet from a second copy. Due to the potential for unauthorized illegal use of credit card numbers obtained by individuals from discarded credit card invoice carbon sheets, it has become a customary practice to return the carbon sheet to the customer along with the second invoice copy. Handling this carbon paper sheet soils the customer's hands and additionally requires the customer to manually shred and dispose of the carbon sheet. In order to avoid this tedious and messy practice, the present invention provides a device which separates the original and second invoice copies from the carbon sheet and directs the carbon sheet to a shredding cutter roller.

2. Description of the Prior Art

Various types of paper shredding devices are known in the prior art. A typical example of such a paper shredding device is to be found in U.S. Pat. No. 3,880,361, which issued to W. Schwarz on Apr. 29, 1975. This patent discloses a device comminuting trash in which two parallel shafts are driven by a motor through a reduction gearing arrangement. A plurality of comminuting blades are provided on the parallel shafts for comminuting trash fed from a gravity feed hopper. U.S. Pat. No. 4,236,676, which issued to A. Bialski et al on Dec. 2, 1980, discloses a device for applying forces to a waste paper mixture to procure progressive fragmentation and resulting in fine paper fragments. U.S. Pat. No. 4,403,743, which issued to J. Ducasse on Sept. 13, 1983, discloses an articulated knife rotor assembly in a machine for comminuting materials which includes a shaft rotated about its longitudinal axis. A plurality of blade holders are rigidly fixed to the shaft for rotation therewith. U.S. Pat. No. 4,489,896, which issued to M. Cerroni on Dec. 25, 1984, discloses a device for comminuting solid refuse. The device utilizes a gravity feed hopper for feeding refuse to a rotating shaft carrying a plurality of cutting blades. U.S. Pat. No. 4,678,126, which issued to C. Prentice et al on July 7, 1987, discloses a shredder which includes a housing for receiving material to be shred and an arbor carrying plural teeth thereon mounted in the housing. An anvil is provided having plural grating members interspersed with the teeth on the arbor, to shred material which is introduced into the housing. The teeth are fixed on the arbor in a helical pattern with each tooth being angularly displaced with respect to the next laterally adjacent tooth.

While the above mentioned devices are suited for their intended usage, none of these devices disclose a paper shredder for separating and shredding a carbon paper sheet from a credit card invoice slip having a first original copy separated by a carbon paper sheet from a second copy. Additionally, none of the aforesaid devices disclose the use of a pair of parallel spaced vacuum plates for separating a first original copy and a second copy from a carbon paper sheet in a credit card invoice and directing these copies to separate receptacles while shredding the carbon paper sheet. Inasmuch as the art is relatively crowded with respect to these various types of paper shredding devices, it can be appreciated that there is a continuing need for and interest in improvements to such paper shredding devices, and in this respect, the present invention addresses this need and interest.

SUMMARY OF THE INVENTION

In view of the foregoing disadvantages inherent in the known types of paper shredding devices now present in the prior art, the present invention provides an improved paper shredding device. As such, the general purpose of the present invention, which will be described subsequently in greater detail, is to provide a new and improved paper shredding device which has all the advantages of the prior art paper shredding devices and none of the disadvantages.

To attain this, a representative embodiment of the concepts of the present invention is illustrated in the drawings and makes use of a rectangular housing which encloses a rotationally driven cutter roller and a pair of adjacent idling anvil rollers. An insertion slot is formed in an end wall of the housing and communicates with an internal channel. A pair of vertically spaced perforated vacuum plates form ceiling and floor portions of the channel adjacent the insertion slot. Upper and lower receptacles are provided and each communicate via a slot with the internal channel. In use, the original copy and the second copy are directed respectively to the upper and lower receptacles and the carbon paper sheet is directed through the internal channel to the cutter roller for shredding. A microswitch is provided for actuating the vacuum plates and cutter roller upon insertion of a credit card invoice into the insertion slot. The cutter roller is driven by a worm gear drive shaft operatively connected to a drive motor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paper shredding device which has all the advantages of the prior art paper shredding devices and none of the disadvantages.

It is another object of the present invention to provide a new and improved paper shredding device which may be easily and efficiently manufactured and marketed.

It is a further object of the present invention to provide a new and improved paper shredding device which is of a durable and reliable construction.

An even further object of the present invention is to provide a new and improved paper shredding device which is susceptible of a low cost of manufacture with regard t both materials and labor, and which accordingly is then susceptible of low prices of sale to the consuming public, thereby making such paper shredding devices economically available to the buying public.

Still yet another object of the present invention is to provide a new and improved paper shredding device which provides in the apparatuses and methods of the prior art some of the advantages thereof, while simultaneously overcoming some of the disadvantages normally associated therewith.

Still another object of the present invention is to provide a new and improved paper shredding device for separating and shredding a carbon paper sheet from a credit card invoice slip having a first original copy separated by a carbon paper sheet from a second copy.

Yet another object of the present invention is to provide a new and improved paper shredding device which utilizes a pair of vertically spaced perforated vacuum plates for separating an original and a second copy of a credit card invoice slip from a central carbon sheet.

Even still another object of the present invention is to provide a new and improved paper shredding device which is automatically actuated by a microswitch upon insertion of a credit card invoice slip into a housing insertion slot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. BRIEF DESCRIPTION OF THE DRAWINGS The invention will be better understood and objects other than those set forth above will become apparent when consideration is given to the following detailed description thereof. Such description makes reference to the annexed drawings wherein:

DESCRIPTION OF THE PREFERRED EMBODIMENT

Figure 1:
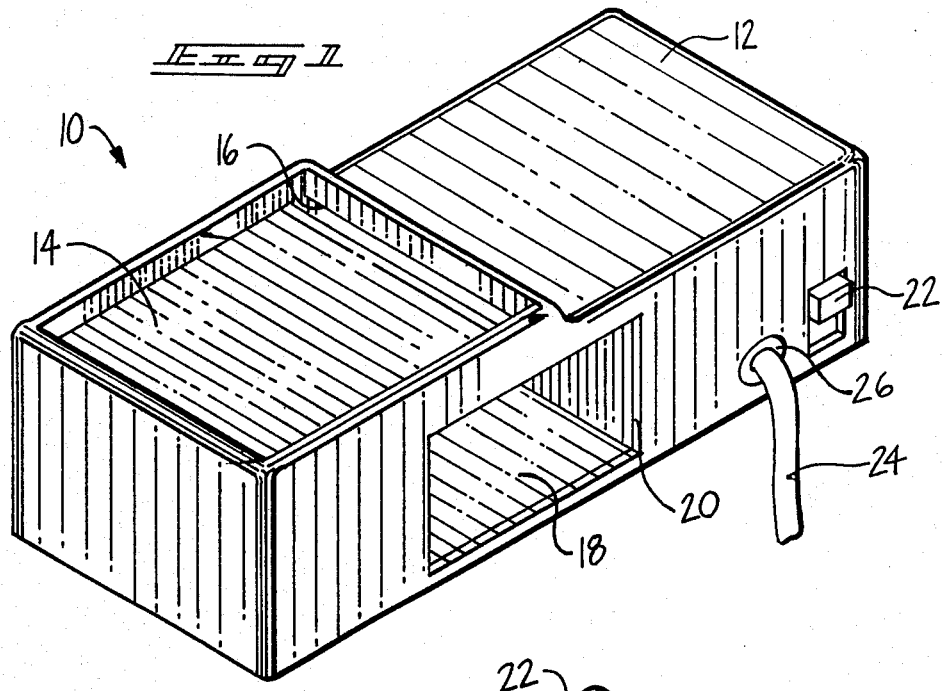
FIG. 1 is a perspective view illustrating the top portion of the paper shredding device according to the present invention.

With reference now to the drawings, and in particular to FIG. 1 thereof, a new and improved paper shredding device embodying the principles and concepts of the present invention and generally designated by the reference numeral 10 will be described.

More specifically, it will be noted that the first embodiment 10 of the invention includes a generally rectangular housing 12 having an open top receptacle 14 on an upper surface thereof. A floor of the receptacle 14 communicates via a slot 16 through a ceiling portion of an internal channel. A hopper 18 within the housing 12 is disposed beneath the internal channel and has a rectangular opening 20 provided in a side wall of the housing 12. A power cord 24 extends through a grommet 26 into the interior of the housing 12 and serves to connect an internal cutter drive motor and vacuum pump with a conventional AC outlet. A safety switch 22 is provided for disconnecting the internal components of the device from the power supply.

Figure 2:
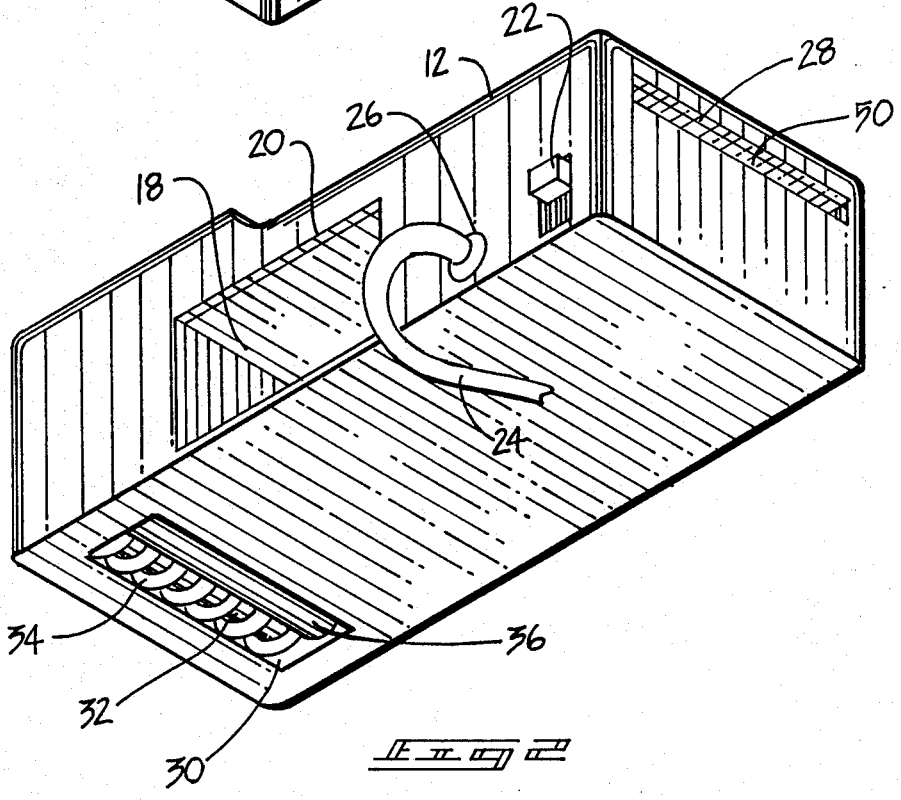
FIG. 2 is a perspective view illustrating the bottom portion of the paper shredding device of the present invention.

As shown in FIG. 2, an invoice insertion slot 28 is provided in an end wall of the housing 12. A pivotal microswitch 50 is positioned in the insertion slot 28 and serves to simultaneously actuate an internal vacuum pump and a cutter drive motor upon insertion of a credit card invoice slip through the slot 28. A rectangular outlet opening 30 is formed on the bottom wall of the housing 12, adjacent an interior cutter roller 32 and a lower idling anvil roller 36. The cutter roller 32 has a hard rubber body portion and is provided with a plurality of laterally spaced hard steel sharpened circular cutting discs 34.

Figure 3:
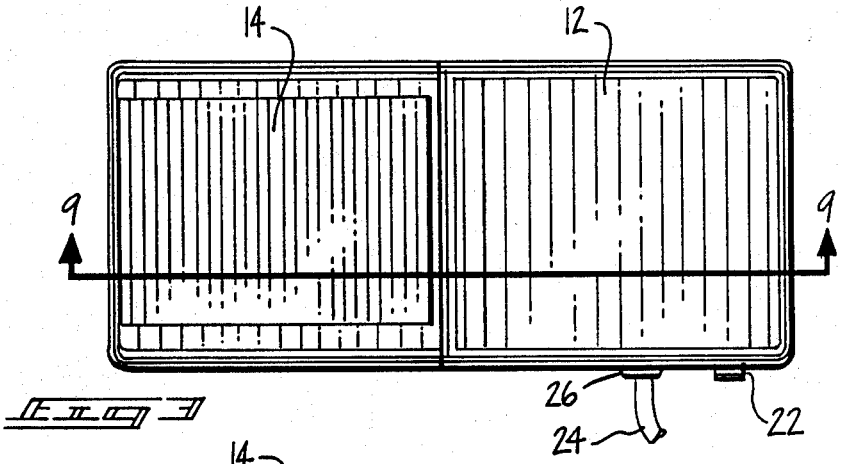
FIG. 3 is a top plan view of the paper shredding device of the present invention.

In FIG. 3, a top plan view is provided which illustrates the open top receptacle 14 provided on an upper surface of the housing 12.

Figure 4:
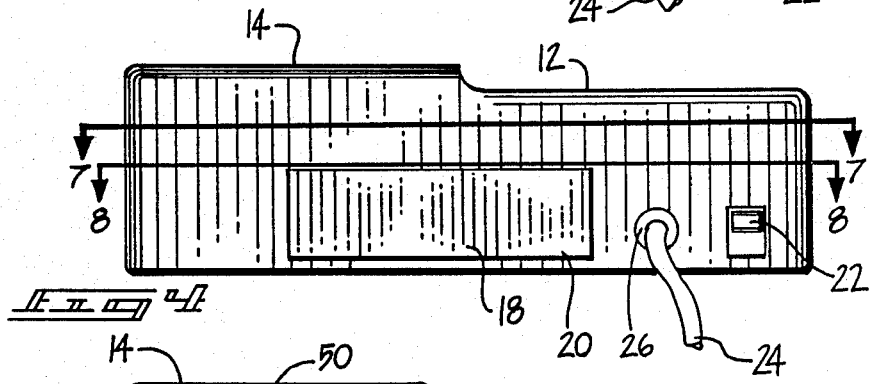
FIG. 4 is a side view of the paper shredding device of the present invention.

In FIG. 4, a side view is provided which illustrates the rectangular side wall opening 20 of the hopper 18.

Figure 5:
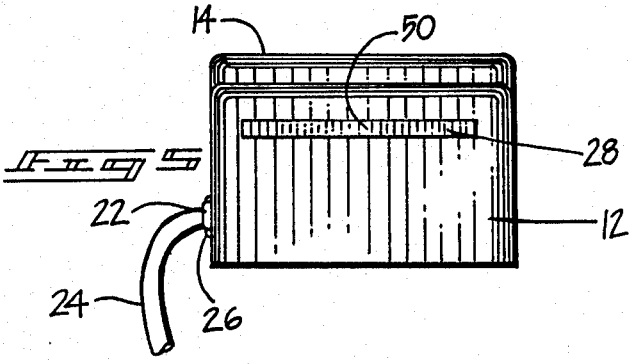
FIG. 5 is a front end view of the paper shredding device of the present invention.

In FIG. 5, a front end view of the housing 12 is provided which illustrates the insertion slot 28.

Figure 6:
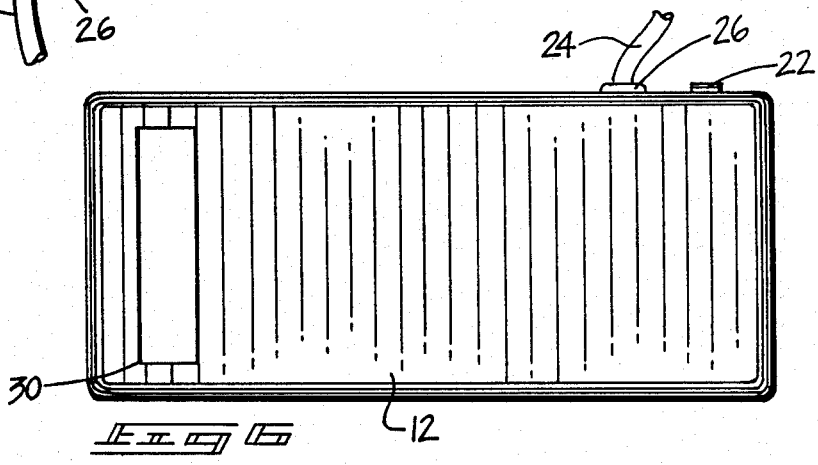
FIG. 6 is a bottom plan view of the paper shredding device of the present invention.

In FIG. 6, a bottom plan view is provided which illustrates the outlet opening 30 formed in the bottom wall of the housing 12.

Figure 7:
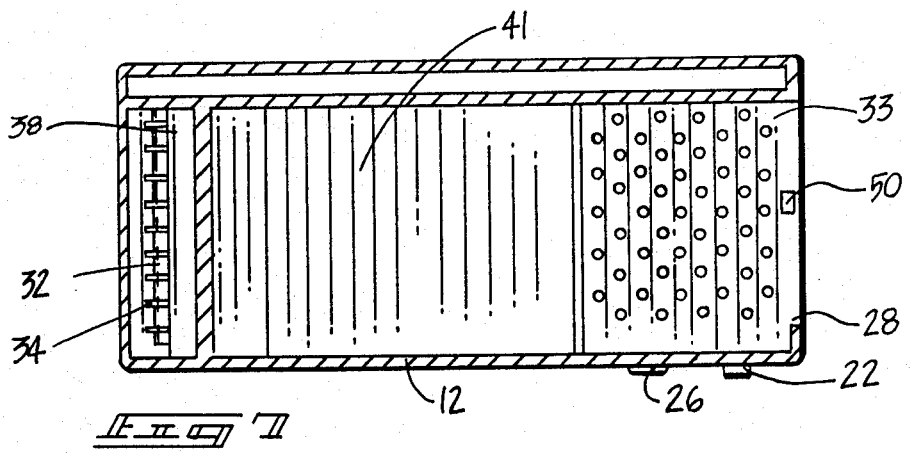
FIG. 7 is a cross sectional view, taken along line 7—7 of FIG. 4, illustrating the internal construction of the paper shredding device of the present invention.

In FIG. 7, a cross sectional view is provided which illustrates the internal construction of the paper shredding device. The insertion slot 28 communicates with an internal channel which has a floor portion formed by a first perforated vacuum plate 33. The transversely extending cutter roller 32 is positioned adjacent a back end wall of the housing 12, opposite the insertion slot 28.

Figure 8:
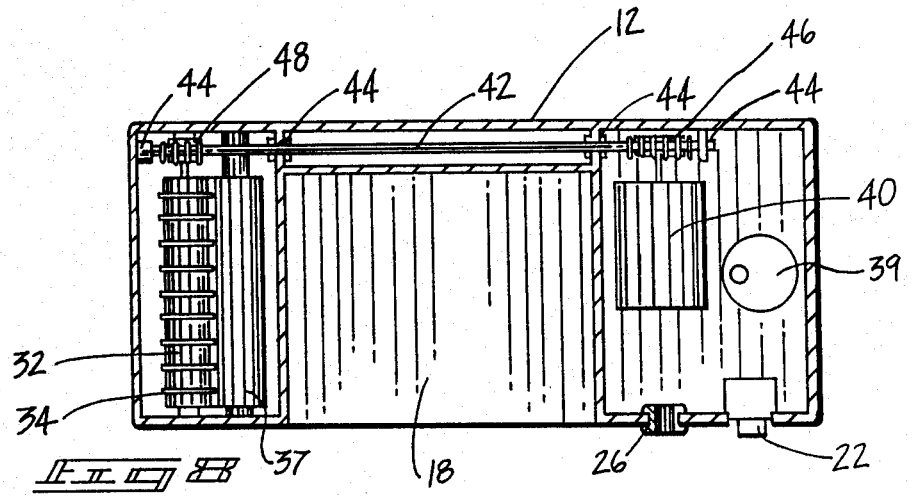
FIG. 8 is a cross sectional view, taken along line 8—8 of FIG. 4, further illustrating the internal construction of the paper shredding device of the present invention.

As shown in FIG. 8, the cutter roller 32 is connected to a cutter drive motor 40 by a drive shaft 42 which is mounted for rotation in a plurality of spaced bearings 44. The drive shaft 42 is operatively connected to the motor 40 and the cutter roller 32 by a pair of worm gear drives 46 and 48. An upper rotationally mounted idling anvil roller 37 extends transversely across the housing 12, adjacent the cutter roller 32, but spaced slightly vertically thereabove.

Figure 9:
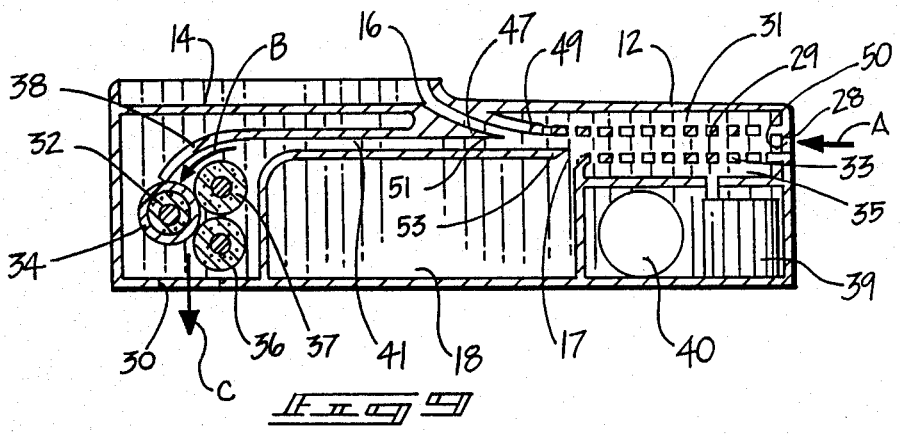
FIG. 9 is a cross sectional view, taken along line 9—9 of FIG. 3, further illustrating the internal construction of the paper shredding device of the present invention.

With reference now to FIG. 9, the construction and operation of the paper shredding device of the present invention will be further described. The first vacuum plate 29 forms a ceiling portion of the internal channel 41, adjacent the insertion slot 28. A second vacuum plate 33 extends generally parallel to the first vacuum plate 29 and forms a floor portion of the channel 41, adjacent the insertion slot 28. A pair of closed vacuum chambers 31 and 35 are disposed on a back side of each of the vacuum plates 29 and 33. The vacuum chambers 31 and 35 are connected by suitable manifold tubing to a vacuum pump 39 located in a lower portion of the housing 12. The vacuum pump manifold supply lines preferably include adjustable needle valves for individually and independently adjusting the vacuum pressure within the chambers 31 and 35. The vacuum plate 29 has an upwardly curving arcuate guide surface 49 which is juxtaposed with a downwardly sloping guide surface 47 of the slot 16 which communicates with the open top receptacle 14. A hopper 18 within a lower portion of the housing 12 communicates with the internal channel 41 through a transverse slot formed in a floor of the channel 41 adjacent an inner end of the vacuum plate 33. An arcuate guide baffle 38 on a ceiling of the channel 41, adjacent the cutter roller 32 serves to direct a carbon paper sheet between the cutter roller 32 and the anvil rollers 36 and 37. The longitudinal axes of the cutter roller 32 and anvil rollers 36 and 37 form an equilateral triangle. The manner of operation of the shredding device of the present invention is initiated by insertion of a credit card invoice slip through the slot 28. The device is specifically adapted for use with a credit card invoice slip of the type having a first original copy separated by a carbon paper sheet from a second copy. The invoice slip is inserted through the slot 28 as indicated by arrow A. This initial insertion activates the pivotal microswitch 50 which energizes the vacuum pump 39 and the cutter drive motor 40. It should be noted that the unbound edges of the invoice slip are inserted first through the slot 28 and the preperforated bound edges are held in the individual's hands. Actuation of the vacuum pump 39 causes a preselected vacuum to be formed in the chambers 31 and 35. The vacuum pressure in the upper chamber 31 causes the original invoice copy to the drawn upwardly against the perforated ceiling vacuum plate 29. The vacuum pressure in the lower chamber 35 causes the second invoice copy to be drawn downwardly against the perforated floor vacuum plate 33. As the insertion of the invoice slip continues, the free end of the second invoice copy is directed downwardly through the transverse slot 17 into the hopper 18. The upper original copy of the invoice slip is similarly directed upwardly through the slot 16 into the upper receptacle 14. The central carbon paper sheet continues along the internal channel 41 and is directed by the arcuate guide baffle 38 between the rotating cutter roller 32 and the idling anvil rollers 36 and 37, as indicated by arrow B. It should be noted that the cutting discs 34 of the cutter roller 32 are dimensioned to be rotated in contact with the outer surface of the anvil rollers 36 and 37. Thus, the carbon paper sheet is pressed against the anvil rollers 36 and 37 and shredded by the cutting discs 34. The shredded slips of carbon paper exit the bottom wall of the housing 12 through the outlet opening 30 and fall as indicated by arrow C into a suitably positioned trash receptacle. As the central carbon sheet is shredded through the rollers 32, 36 and 37, the preperforated trailing edges of the original and second invoice copies are pressed against the sharpened severing edges 51 and 53. This cuts the original and second copies loose from the carbon copy and allows the remaining portion of the carbon sheet to be drawn through the channel 41 by virtue of being pinched between the cutting roller 32 and anvil rollers 36 and 37. The original invoice copy may then be removed from the receptacle 14 and the second or customer copy may be removed from the hopper 18 and handed to the customer. The device may be located in such a manner that the shredded carbon falls within the view of the customer into a trash receptacle, thus affording the customer added peace of mind. The cutter drive motor 40 and vacuum pump 39 may be controlled by a suitable timing circuit which automatically disconnects them from the power supply after a suitable time interval has passed from the initial activation of the microswitch 50.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A paper shredding device for separating and shredding a carbon paper sheet from a credit card invoice slip having a first original copy separated by a carbon paper sheet from a second copy, comprising:

a generally rectangular housing;

an invoice insertion slot in an end wall of said housing;

an internal channel in said housing communicating with said invoice insertion slot;

a first vacuum plate forming a ceiling portion of said channel adjacent said insertion slot;

a second vacuum plate extending generally parallel to said first vacuum plate and forming a floor portion of said channel adjacent said insertion slot;

a closed vacuum chamber disposed on a back side of each of said vacuum plates, said vacuum chambers connected to a vacuum pump in said housing;

said first vacuum plate having an upwardly curving arcuate guide surface;

an open topped receptacle on an upper surface of said housing;

a floor of said receptacle having a downwardly sloping guide surface juxtaposed with said upwardly curving arcuate guide surface and forming a passage connecting said channel with said receptacle;

a first sharpened transverse severing edge on said downwardly sloping guide surface, adjacent said passage;

a hopper within said housing beneath said channel, said hopper having a rectangular opening in a side wall of said housing;

a transverse slot in a floor of said channel, adjacent an inner end of said second vacuum plate, said transverse slot connecting said channel with said hopper;

a second sharpened transverse severing edge on said channel floor, adjacent said transverse slot;

a transversely extending cutter roller having a rubber cylindrical body provided with a plurality of spaced circular cutting wheels disposed adjacent an end of said channel;

a pair of parallel idling rubber anvil rollers extending transversely in said housing adjacent to and parallel with said cutter roller;

central longitudinal axes of said cutter roller and said anvil rollers forming an equilateral triangle;

a cutter drive motor connected by a worm gear drive shaft for rotating said cutter roller;

an arcuate guide baffle on a ceiling of said channel adjacent said cutter roller for directing a carbon paper sheet between said cutter roller and said anvil rollers;

an outlet opening in a bottom wall of said housing adjacent said cutter roller for discharging shredded carbon paper;

a power cord for connecting said vacuum pump and said cutter drive motor to an electrical outlet;

a microswitch in said insertion slot for simultaneously actuating said vacuum pump and said outlet drive motor; and a safety switch in said housing for disconnecting said power cord from said microswitch.

2. A paper shredding device for separating and shredding a carbon paper sheet from a credit card invoice slip having a first original copy separated by a carbon paper sheet from a second copy, comprising:

a housing;

an internal channel in said housing;

an insertion slot in said housing communicating with said internal channel;

vacuum means in said housing for separating said original and second copies form said carbon sheet; and means for shredding said carbon sheet in said housing.

3. The paper shredding device of claim 2, wherein said vacuum means comprises:

a first vacuum plate forming a ceiling portion of said internal channel adjacent said insertion slot;

a second vacuum plate extending generally parallel to said first vacuum plate and forming a floor portion of said channel adjacent said insertion slot; and a closed vacuum chamber disposed on a back side of each of said vacuum plates, said vacuum chambers connected to a vacuum pump in said housing.

4. The paper shredding device of claim 3, wherein said first vacuum plate has an upwardly curving arcuate guide surface;

an open top receptacle on an upper surface of said housing;

a floor of said receptacle having a downwardly sloping guide surface juxtaposed with said upwardly curving arcuate guide surface and forming a passage connecting said internal channel with said receptacle; and a first sharpened severing edge on said downwardly sloping guide surface adjacent said passage.

5. The paper shredding device of claim 4., further comprising a hopper within said housing beneath said channel, said hopper having a rectangular opening in a side wall of said housing;

a transverse slot in a floor of said channel, adjacent an inner end of said second vacuum plate;

said transverse slot connecting said channel with said hopper; and a second sharpened severing edge on said channel floor, adjacent said transverse slot.

6. The paper shredding device of claim 2, wherein said shredding means comprises;

a transversely extending cutting roller having a rubber cylindrical body provided with a plurality of spaced circular wheels disposed adjacent an end of said internal channel;

a pair of parallel idling rubber anvil rollers extending transversely in said housing adjacent said cutter roller;

central longitudinal axes of said cutter roller and said anvil rollers forming an equilateral triangle; and a cutter drive motor connected by a worm gear drive shaft for rotating said cutter roller.

* * * * *